United States Patent [19]

Petitpierre

[11] 4,291,901

[45] Sep. 29, 1981

[54] PRESSURE-SENSITIVE OR HEAT-SENSITIVE RECORDING MATERIAL

[75] Inventor: Jean C. Petitpierre, Kaiseraugst, Switzerland

[73] Assignee: Ciba-Geigy Corporation, Ardsley, N.Y.

[21] Appl. No.: 95,119

[22] Filed: Nov. 16, 1979

[30] Foreign Application Priority Data

Nov. 23, 1978 [CH] Switzerland ..... 12026/78
Oct. 26, 1979 [CH] Switzerland ..... 9628/79

[51] Int. Cl.[3] ..... B41M 5/16; B41M 5/18; B41M 5/22

[52] U.S. Cl. ..... 282/27.5; 427/150; 427/151; 428/307; 428/488; 428/913; 428/914

[58] Field of Search ..... 106/21; 282/27.5; 427/150, 151, 152; 428/307, 411, 488, 913, 914, 537

[56] References Cited

U.S. PATENT DOCUMENTS 4,210,345 7/1980 Kosche ..... 282/27.5

FOREIGN PATENT DOCUMENTS 41-4700 5/1966 Japan ..... 427/150
41-17191 9/1966 Japan ..... 427/150
1456208 11/1976 United Kingdom ..... 282/27.5

*Primary Examiner*—Bruce H. Hess
*Attorney, Agent, or Firm*—Edward McC. Roberts; John P. Spitals

[57] ABSTRACT

A pressure-sensitive or heat-sensitive recording material which contains in its color reactant system, as developer for color formers, at least one compound of the formula

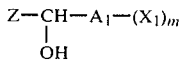

(1)

wherein Z is the radical of a reactive organic methylene or methyl compound or a radical of the formula

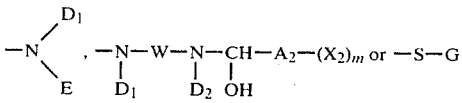

(1a) (1b) (1c)

wherein each of $A_1$ and $A_2$ independently is carbon or unsubstituted or substituted alkylene, arylene or aralkylene, each of $X_1$ and $X_2$ is halogen, cyano or nitro, each of $D_1$, $D_2$ and E independently is unsubstituted or substituted alkyl, aralkyl, aryl, alkanoyl, alkylsulfonyl, aroyl, arylsulfonyl, cyanoamidino, or is the group

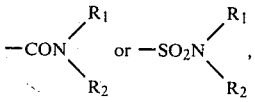

wherein each of $R_1$ and $R_2$ independently is hydrogen or unsubstituted or substituted alkyl, aryl or aralkyl, whilst $D_1$ and $D_2$ are also hydrogen, or each of the pairs of substituents ($R_1$ and $R_2$) and ($D_1$ and E) together with the nitrogen atom to which said pair is attached is a 5- or 6-membered heterocyclic radical, W is —CO—, —$SO_2$—, —COCO—,

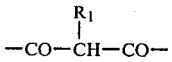

or unsubstituted or substituted alkylene or phenylene, G is unsubstituted or substituted alkyl, aralkyl or aryl or is a 5- or 6-membered heterocyclic radical, and m is 1 to 6.

20 Claims, No Drawings

PRESSURE-SENSITIVE OR HEAT-SENSITIVE RECORDING MATERIAL

The present invention relates to a pressure-sensitive or heat-sensitive recording material which contains in its colour reactant system, as developer for colour formers, at least one compound of the formula

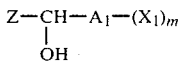

(1)

wherein Z is the radical of a reactive organic methylene or methyl compound or a radical of the formula

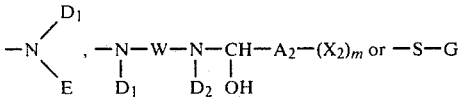

(1a) (1b) (1c)

wherein each of $A_1$ and $A_2$ independently is carbon or unsubstituted or substituted alkylene, arylene or aralkylene, each of $X_1$ and $X_2$ is halogen, cyano or nitro, each of $D_1$, $D_2$ and E independently is unsubstituted or substituted alkyl, aralkyl, aryl, alkanoyl, alkylsulfonyl, aroyl, arylsulfonyl, cyanoamidino, or is the group

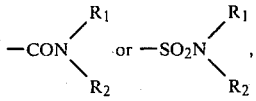

wherein each of $R_1$ and $R_2$ independently is hydrogen or unsubstituted or substituted alkyl, aryl or aralkyl, whilst $D_1$ and $D_2$ are also hydrogen, or each of the pairs of substituents ($R_1$ and $R_2$) and ($D_1$ and E) together with the nitrogen atom to which said pair is attached is a 5- or 6-membered heterocyclic radical, W is —CO—, —$SO_2$—, —COCO—,

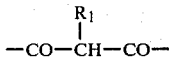

or unsubstituted or substituted alkylene or phenylene, G is unsubstituted or substituted alkyl, aralkyl or aryl or is a 5- or 6-membered heterocyclic radical, and m is 1 to 6.

Preferred compounds of the formula (1) are those wherein each of $X_1$ and $X_2$ is halogen, especially chlorine, $D_1$, $D_2$ and $R_1$ are preferably hydrogen and m is preferably 1 to 3.

Alkyl groups represented by, or alkyl moieties contained in, the substituents $D_1$, $D_2$, E, G, $R_1$ and $R_2$ can be straight-chain or branched. The alkyl groups can contain 1 to 18, preferably 1 to 12, and most preferably 1 to 4, carbon atoms. Examples of such alkyl groups are methyl, ethyl, propyl, isopropyl, n-butyl, sec-butyl, n-hexyl, n-octyl, n-dodecyl or stearyl.

Substituted alkyl groups in the D, E, G and R radicals are in particular cyanoalkyl, haloalkyl, alkoxyalkyl or carbalkoxyalkyl, each containing a total of 2 to 5 carbon atoms, e.g. β-cyanoethyl, β-chloroethyl, β-methoxyethyl, β-ethoxyethyl, carbomethoxyethyl or carboethoxyethyl. Aralkyl represented by D, E, G and R is usually phenylethyl and especially benzyl, whilst aryl preferably denotes naphthyl, diphenyl and especially phenyl. The aralkyl and aryl radicals may be substituted by halogen, nitro, lower alkyl, lower alkoxy, lower alkylcarbonyl or lower alkoxycarbonyl groups.

Alkanoyl is preferably derived from aliphatic monocarboxylic acids containing 1 to 22 carbon atoms, e.g. acetic acid, propionic acid, butyric acid, lauric acid, palmitic acid, stearic or behenic acid. Preferably alkanoyl contains 1 to 4 carbon atoms and is especially acetyl or propionyl, and also cyanoacetyl.

Aroyl is derived from corresponding aromatic monocarboxylic acids and is preferably benzoyl.

Preferred substituents of aryl, aralkyl and aroyl in the definition of the D, E, G and R radicals are e.g. halogen, nitro, methyl, methoxy, ethoxy, carbomethoxy, carboethoxy or acetyl. Examples of such araliphatic and aromatic radicals are methylbenzyl, chlorobenzyl, nitrophenyl, tolyl, xylyl, chlorophenyl, methoxyphenyl, carbomethoxyphenyl, acetophenyl, chlorobenzoyl or methylbenzoyl.

Alkylsulfonyl contains preferably 1 to 4 carbon atoms and is in particular methylsulfonyl or ethylsulfonyl. Arylsulfonyl is preferably phenylsulfonyl.

A heterocyclic radical represented by the pair of substituents ($R_1$ and $R_2$) or ($D_1$ and E) together with the nitrogen atom to which said pair is attached is e.g. pyrrolidino, piperidino, pipecolino, morpholino, thiomorpholino or piperazino. $D_1$ and E together with the nitrogen atom to which they are attached can also form an oxazolidone radical. A heterocyclic radical represented by G is preferably a 2-imidazolinyl radical.

Alkylene in the definition of $A_1$, $A_2$ and W can contain 1 to 12, preferably 1 to 3, carbon atoms, and is e.g. methylene, ethylene, propylene, isopropylidene, hexylene or dodecylene. The alkyl chains can be substituted e.g. by halogen, lower alkyl, lower alkoxy, carboxyl, -$SO_3H$, phenyl or halophenyl.

Preferably each of $A_1$ and $A_2$ independently represents a carbon atom, while each of $X_1$ and $X_2$ is preferably halogen, especially chlorine, and m is 3.

$A_1$ and $A_2$ as aralkylene and arylene are preferably phenylenemethylene and phenylene respectively, each of which can be ring-substituted by halogen, carboxyl, -$SO_3H$, lower alkyl or lower alkoxy.

Within the scope of the definition of the above radicals, lower alkyl and lower alkoxy usually denote those groups or group constituents which contain 1 to 5, especially 1 to 3, carbon atoms, e.g. methyl, ethyl, n-propyl, isopropyl, n-butyl, sec-butyl, tert-butyl, or amyl, and methoxy, ethoxy or isopropoxy.

Throughout this specification, halogen in conjunction with substituents of compounds of the formula (1) is e.g. fluorine, bromine or preferably chlorine.

Z in formula (1) is preferably a radical of the formula (1b), and especially a radical of the formula (1a).

Important colour developers are compounds of the formula (1), in which Z is the radical of the formula

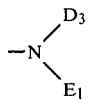

(2a)

or

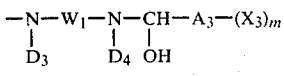

(2b)

wherein each of $D_3$, $D_4$ and $E_1$ independently is alkyl of 1 to 12 carbon atoms, benzyl, phenyl, alkanoyl of 1 to 12 carbon atoms, benzoyl, alkylsulfonyl of 1 to 12 carbon atoms, phenylsulfonyl, each of which is unsubstituted or substituted by halogen, lower alkyl, lower alkoxy, lower alkylcarbonyl or lower alkoxycarbonyl, or is the group

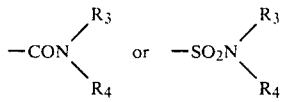

wherein each of $R_3$ and $R_4$ independently is hydrogen, alkyl of 1 to 12 carbon atoms, benzyl or phenyl, whilst $D_3$ and $D_4$ are also hydrogen, or the pairs of substituents ($R_3$ and $R_4$) and ($D_3$ and $E_1$) together with the nitrogen atom to which each pair is attached form a 5- or 6-membered heterocyclic ring which can contain further heteroatoms selected from the group consisting of nitrogen, oxygen or sulfur, $W_1$ is —CO—, —$SO_2$—, —CO—CO—, —CO—$CH_2$—CO—, or alkylene of 2 to 6 carbon atoms or phenylene, each of which is unsubstituted or substituted by lower alkyl, lower alkoxy or halogen, and $A_3$ is carbon or alkylene of 1 to 6 carbon atoms or phenylene, $X_3$ is halogen, and m is 1 to 3.

Particularly interesting colour developers, however, are those of the formula

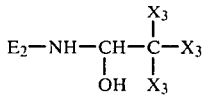

(3)

wherein $E_2$ is acetyl, benzoyl, acetophenyl, e.g. 2- or 4-acetophenyl, carbomethoxyphenyl, e.g. 2- or 4-carbomethoxyphenyl, methylsulfonyl, phenylsulfonyl, N-methylcarbamyl, N-phenylcarbamyl, N-tolylcarbamyl or the group

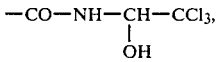

and $X_3$ is halogen, especially chlorine.

Preferred compounds of the formula (3) are those in which $E_2$ is acetyl, benzoyl, acetophenyl, e.g. 4-acetophenyl, N-methylcarbamyl, N-tolylcarbamyl or especially N-phenylcarbamyl.

The colour developers of the formula (1), in which Z is a radical of the formula —S—G (1c)

are thioether compounds which are derived from corresponding thiols. Particularly suitable thioether compounds contain a radical Z of the formula —S—$G_1$ (2c)

wherein $G_1$ is $C_1$-$C_{18}$alkyl, preferably $C_1$-$C_4$alkyl, benzyl or phenyl, each of which is unsubstituted or substituted by halogen, lower alkyl or lower alkoxy, or is a 5- or 6-membered heterocyclic ring which contains 1 or 2 ring nitrogen atoms.

Particularly interesting thioether compounds are those of the formula

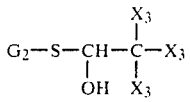

(4)

wherein $G_2$ is $C_1$-$C_{18}$alkyl, preferably $C_1$-$C_4$alkyl, phenyl, halophenyl, $C_1$-$C_4$alkoxyphenyl or dihydroimidazolyl-2- and $X_3$ is halogen, preferably chlorine.

Where the substituent Z is the radical of an organic compound containing an activated methylene or methyl group, it is bonded through the methylene or methyl group to the methine group

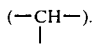

.

Such a radical Z is advantageously a group of the formula

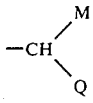

(1d)

wherein each of M and Q independently is cyano, nitro, unsubstituted or substituted alkanoyl, alkoxycarbonyl or aroyl, or is the group

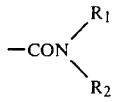

in which each of $R_1$ and $R_2$ is hydrogen or unsubstituted or substituted alkyl, aryl or aralkyl, or $R_1$ and $R_2$ together with the nitrogen atom to which they are attached are a 5- or 6-membered heterocyclic radical, whilst M is also hydrogen, or M and Q together with the carbon atom which links them form a carbocyclic or heterocyclic ring which contains a keto group adjacent to the linking carbon atom.

A ring formed by M and Q together with the carbon atom linking them is advantageously a radical of the formula

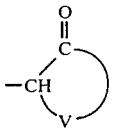

($1d_1$)

wherein V represents those members which are necessary to complete a 5- or 6-membered carbocyclic or heterocyclic ring system. In this regard V can also complete a radical derived from polynuclear fused heterocyclic ring systems which preferably contain a fused benzene ring. Examples of such carbocyclic and heterocyclic ring systems are 5,5-dimethyl-1,3-dioxocyclohexane, 1-methyl- or 1-ethyl-4-hydroxy-2-quinolone, 6-hydroxy-5-cyano- or -carbamoyl-4-methyl-2-pyridone or 6-hydroxy-5-cyano- or -carbamoyl-1,4-dimethyl-2-pyridone or 1-phenyl-3-methyl-5-pyrazolone.

Preferred radicals of the formula (1d) have the formula

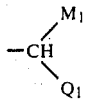

(2d)

wherein each of $M_1$ and $Q_1$ independently is cyano, nitro, or $C_2$–$C_{13}$-alkanoyl, $C_2$–$C_{13}$alkoxycarbonyl, benzoyl or N-phenylcarbamyl, each of which is unsubstituted or substituted by one or more members selected from the group consisting of halogen, nitro, lower alkyl or lower alkoxy, and $M_1$ is also hydrogen, or $M_1$ and $Q_1$ together with the carbon atom which links them form a 5- or 6-membered carbocyclic or heterocyclic ring which contains a keto group adjacent to the linking carbon atom.

Especially preferred colour formers within the scope of those defined above are the compounds of the formula

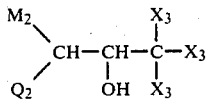

(5)

wherein $M_2$ is hydrogen, lower alkylcarbonyl or N-phenylcarbamyl, $Q_2$ is nitro, lower alkylcarbonyl, lower alkoxycarbonyl or benzoyl, and $X_3$ is halogen.

The compounds of the formula (1) employed in this invention as developers or electron acceptors for colour formers are products which are obtained e.g. by reaction of 1 mole of a reactive organic methylene or methyl compound, or of a compound of the formula $$D_1—NH—E \quad (6)$$

or $$G—SH \quad (7)$$

wherein $D_1$, E and G are as defined above, with 1 mole of an aldehyde of the formula $$(X_1)_m A_1—CHO \quad (8)$$

wherein $A_1$, $X_1$ and m have the given meanings, or by reaction of 1 mole of a compound of the formula

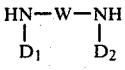

(9)

wherein $D_1$, $D_2$ and W have the given meanings, with 1 mole of each of the aldehydes of the formulae (8) and (10)

$$(X_2)_m—A_2—CHO \quad (10)$$

wherein $A_2$, $X_2$ and m have the given meanings. The aldehydes of the formulae (8) and (10) can also be employed in the form of their hydrates.

Compounds of the formula (1) and methods of obtaining them are described e.g. in Chemical Reviews 75 (1975), 259–289; F. Chattaway, G. Kerr, C. Lawrence, J. Chem. Soc. 30 (1933); and F. Chattaway and E. James, Proc. Roy. Soc. London 134, 372 (1931).

Individual examples of starting materials of the formula (6) are methylurea, ethylurea, phenylurea, p-nitrophenylurea, o- or p-tolylurea, N,N-dimethylurea, N,N-diethylurea, N,N-diphenylurea, aniline, 2-carbomethoxyaniline, 4-acetoaniline, dicyandiamide, N-phenylmalonic diamide or cyanoacetamide.

Individual examples of starting materials of the formula (9) are urea, oxalic diamide, malonic diamide or ethylmalonic diamide.

Individual examples of thio compounds of the formula (7) are ethylmercaptan, propylmercaptan, octylmercaptan, dodecylmercaptan, thiophenyl, 4-chlorothiophenol, 4-nonylthiophenol, 4-isopropylthiophenol or ethylenethiourea.

The reactive organic methylene and methyl compounds are e.g. compounds which have the formula $$M—CH_2—Q \quad (11)$$

wherein M and Q have the given meanings. Individual examples of starting materials of the formula (11) are: acetoacetanilide, chloroacetoacetanilides, acetoacetic toluidides, acetoacetic anisidides, acetoacetic phenetidides, benzoylacetanilides, N,N'-diphenylmalonic diamide, N-phenylmalonic diamide, malonic diamide, acetylacetone, acetophenone, dimethyl malonate, diethyl malonate, diphenyl malonate, nitromethane, methyl acetate, ethyl acetate, phenyl acetate, 1-phenyl-3-methyl-5-pyrazolone, 1-methyl-2,4-dioxoquinoline, 5,5-dimethyl-1,3-dioxocyclohexane or malonic dinitrile.

Examples of starting aldehydes of the formulae (8) and (10) are: chloroacetaldehyde, bromoacetaldehyde, trichloroacetaldehyde, tribromoacetaldehyde, fluoroacetaldehyde, trifluoroacetaldehyde, tribromopropionaldehyde, α-chlorocrotonaldehyde, trichlorobutyraldehyde, 2,3-dibromo-3,3-dichloropropional, 2,2,3-trichloropentanal, trichlorobenzaldehyde, 2,3-dichloro-3-phenylpropionaldehyde, 2,2,3-trichloro-3-phenylpropionaldehyde, 2-chloro-2,3-dibromo-3-phenylpropionaldehyde and 2,2,3-trichloro-3-(3'-chlorophenyl)-propionaldehyde.

The compounds of the formulae (1) to (5) employed in this invention are virtually colourless and odourless and are very reactive with the conventional colour formers, so that spontaneous, permanent and non-fading recordings or copies are obtained.

The colour formers suitable for the recording or copying material employed in this invention are known colourless or faintly coloured substances which, when brought into contact with the compounds of the formulae (1) to (5), become coloured or change colour. Colour formers or mixtures thereof can be employed, e.g. those belonging to the classes of the phthalides, fluoranes, spiropyranes, azomethines, triarylmethane-leuco dyes, of the substituted phenoxazines or phenothiazines, and of the chromeno or chromane colour formers. Examples of such suitable colour formers are: crystal violet lactone (Registered Trademark), 3,3-(bisaminophenyl)-phthalides, 3,3-(bissubstituted indolyl)-phthalides, 3-(aminophenyl)-3-indolyl-phthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or -3-lower alkylfluoranes, 6-dialkylamino-2-dibenzylaminofluoranes, bis-(aminophenyl)-furyl-, -phenyl- or -carbazolylmethanes, or benzoyl-leucomethylene blue.

The compounds of the formula (1) are suitable as colour developers for use in a pressure-sensitive or especially heat-sensitive recording material, which can also be a copying material.

A pressure-sensitive material consists for example of at least one pair of sheets, which contain at least one colour former dissolved in an organic solvent, and a developer of the formula (1). The colour former effects a coloured marking at those points where it comes into contact with the developer.

The developers of the formula (1) can be used by themselves or in admixture with known developers. These developers are preferably applied in the form of a layer to the face of the receiver sheet.

Typical examples of such well-known developers are attapulgite clay, bentonite, acid-activated bentonite, halloysite, montmorillonite, silica, alumina, aluminium sulfate, aluminium phosphate, zinc chloride, kaolin or any clay or acidic organic compound, for example unsubstituted or ring-substituted phenols, salicylic acid or salicylates and their metal salts, or an acidic polymer material, for example a phenolic polymer, an alkylphenolacetylene resin, a maleic acid colophonium resin or a partially or completely hydrolysed polymer of maleic acid and styrene, ethylene or vinyl methyl ether, or carboxypolymethylene.

In order to prevent the colour formers contained in the pressure-sensitive recording material from becoming active prematurely, they are usually separated from the developer. This can advantageously be accomplished by incorporating the colour formers in foam-like, sponge-like or honeycomb-like structures. Preferably, the colour formers are enclosed in microcapsules, which usually can be ruptured by pressure.

When the capsules are ruptured by pressure, for example with a pencil, and the colour former solution is transferred in this manner to an adjacent sheet which is coated with the developer of the formula (1), a coloured area is produced. This colour results from the dye which is formed and which is absorbed in the visible range of the electromagnetic spectrum.

The colour formers are encapsulated preferably in the form of solutions in organic solvents. Examples of suitable solvents are preferably non-volatile solvents, for example a polyhalogenated paraffin, such as chloroparaffin, or a polyhalogenated diphenyl, such as trichlorodiphenyl, and also tricresyl phosphate, di-n-butylphthalate, an aromatic ether, such as benzylphenyl ether, a hydrocarbon oil, such as paraffin or kerosene, an alkylated derivative of diphenyl, naphthalene or triphenyl, terphenyl, dibenzyl toluene, partially hydrogenated terphenyl, or other chlorinated or hydrogenated, condensed aromatic hydrocarbons. Mixtures of different solvents are often used in order to obtain an optimum solubility for the colour formation, a rapid and intense colouration, and a viscosity which is advantageous for the microencapsulation.

The capsule walls can be formed evenly around the droplets of the colour former solution by coacervation; and the encapsulating material can consist of gelatin and gum arabic, as described e.g. in U.S. Pat. No. 2,800,457. The capsules can also be formed preferably from an aminoplast or a modified aminoplast by polycondensation, as described in British patent specification Nos. 989,264, 1,156,725, 1,301,052 and 1,355,124. Also suitable are microcapsules which are formed by interfacial polymerisation, e.g. capsules formed from polyester, polycarbonate, polysulfonamide, polysulfonate, but in particular from polyamide or polyurethane.

The microcapsules containing the colour formers can be used for the production of a wide variety of known kinds of pressure-sensitive copying material. The various systems differ substantially from one another in the arrangement of the capsules, the colour reactants, i.e. the developers, and the support. A preferred arrangement is that in which the encapsulated colour former is in the form of a layer on the back of a transfer sheet and the developer is in the form of a layer on the face of a receiver sheet. However, the components can also be used in the paper pulp.

Another arrangement of the constituents is that wherein the microcapsules which contain the colour former, and the developer, are in or on the same sheet, in the form of one or more individual sheets, or are present in the paper pulp.

The capsules are preferably secured to the support by means of a suitable adhesive. As paper is the preferred support, these adhesives are principally paper-coating agents, for example gum arabic, polyvinyl alcohol, hydroxymethyl cellulose, casein, methyl cellulose, dextrin, starch or polymer lattices.

The paper employed comprises not only normal paper made from cellulose fibres, but also paper in which the cellulose fibres are replaced (partially or completely) by synthetic polymer fibres.

The compounds of the formulae (1) to (5), and especially those of the formula (3), are preferably employed as developers in a thermoreactive recording material. This recording material usually contains at least one carrier, one colour former, one solid developer and, optionally, also a binder. Thermoreactive recording systems comprise, for example, heat-sensitive recording and copying materials and papers. These systems are used, for example, for recording information, e.g. in electronic computers, teleprinters or telewriters, or in recording and measuring instruments. The image (mark) formation can also be effected manually with a heated pen. Laser beams can also be used to produce heat-induced marks. The thermoreactive recording material can be so composed that the colour former is dispersed or dissolved in one binder layer and the developer is dissolved or dispersed in the binder in a second layer. Another possibility consists in dispersing both the colour former and the developer in one layer. By means of heat the binder is softened at specific areas and the colour former comes into contact with the developer at those points where heat is applied and the desired colour develops at once. The developers of the formula (1) can be used by themselves, in admixture with each other, or in admixture with other known developers.

For this purpose it is known to employ the same developers as are used in pressure-sensitive papers, and also phenolic compounds, e.g. 4-tert-butylphenol, 4-phenylphenol, 4-hydroxydiphenyl ether, α-naphthol, β-naphthol, 4-hydroxymethylbenzoate, 4-hydroxyacetophenone, 2,2'-dihydroxydiphenyl, 4,4-isopropylidenediphenol, 4,4'-isopropylidene-bis-(2-methylphenol), 4,4'-bis-(hydroxyphenyl)valeric acid, hydroquinone, pyrogallol, phloroglucinol, p-, m- and o-hydroxybenzoic acid, gallic acid, 1-hydroxy-2-naphthoic acid, as well as boric acid and organic, preferably aliphatic, dicarboxylic acids, for example tartaric acid, oxalic acid, maleic acid, citric acid, citraconic acid and succinic acid.

Fusible, film-forming binders are preferably used for the production of the thermoreactive recording material. These binders are normally water-soluble, whereas the colour formers and the developers are insoluble in water. The binder should be able to disperse and fix the colour former and the developer at room temperature.

The action of heat softens or melts the binder, so that the colour former comes in contact with the developer and a colour is able to form. Examples of binders which are soluble, or at least swellable, in water are e.g. hydrophilic polymers, for example polyvinyl alcohol, polyacrylic acid, hydroxyethyl cellulose, methyl cellulose, carboxymethyl cellulose, polyacrylamide, polyvinyl pyrrolidone, gelatin and starch.

If the colour former and the developer are in two separate layers, it is possible to use water-insoluble binders, i.e. binders which are soluble in non-polar or only weakly polar solvents, for example natural rubber, synthetic rubber, chlorinated rubber, alkyd resins, polystyrene, styrene/butadiene copolymers, polymethylmethacrylates, ethyl cellulose, nitrocellulose and polyvinyl carbazole. The preferred arrangement, however, is that in which the colour former and the developer are contained in one layer in a water-soluble binder.

The thermoreactive coatings can contain further ingredients. To improve the degree of whiteness, to facilitate the printing of papers, and to prevent the heated pen from sticking, the coatings can contain e.g. talc, $TiO_2$, ZnO, $CaCO_3$, inert clays or also organic pigments, for example urea/formaldehyde polymers. In order to effect the colour formation only within a limited temperature range, it is possible to add substances such as urea, thiourea, acetamide, acetanilide, stearic amide, phthalic anhydride phthalic nitrile or other appropriate fusible products which induce the simultaneous melting of the colour former and developer. Thermographic recording materials preferably contain waxes.

In the following Examples, which further illustrate the present invention, the percentages are by weight unless otherwise indicated.

EXAMPLE 1

A solution of 3 g of crystal violet lactone in 97 g of partially hydrogenated terphenyl is emulsified in a solution of 12 g of pigskin gelatin in 88 g of water of 50° C. A solution of 12 g of gum arabic in 88 g of water of 50° C. is then added, followed by the addition of 200 ml of water of 50° C. The resulting emulsion is poured into 600 g of ice-water and cooled, whereupon the coacervation is effected. A sheet of paper is coated with the resulting suspension of microcapsules and dried. A second sheet of paper is coated with a compound of the formula

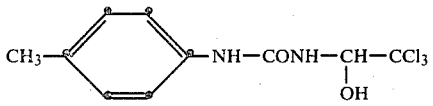

(21)

(m.p. 180° C.). The first sheet and the sheet of paper coated with the compound of the formula (21) are laid on top of each other with the coated sides face to face. Pressure is exerted on the first sheet by writing by hand or typewriter and an intense blue copy develops on the sheet coated with the developer of the formula (21).

EXAMPLE 2

In a ball mill, 32 g of a compound of the formula

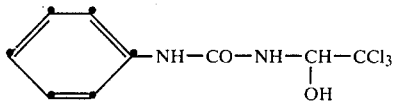

(22)

(m.p. 153° C.), 3.8 g of the distearylamide of ethylenediamine, 39 g of kaolin, 20 g of an 88% hydrolysed polyvinyl alcohol and 500 ml of water are ground to a particle size of about 5μ. In a second ball mill, 6 g of 2-phenylamino-3-methyl-6-diethylamino-fluorane, 3 g of a 88% hydrolysed polyvinyl alcohol and 60 ml of water are ground to a particle size of about 3μ.

Both dispersions are mixed and applied to paper to a dry coating weight of 5.5 g/m². An intense black colour of excellent lightfastness is produced by contacting the paper with a heated ball-point pen.

The developers of the formula (23) listed in the table below can also be used in the same way as described in Examples 1 and 2.

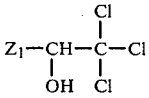

(23)

TABLE

| Example | $Z_1$ | m.p. °C. |
|---|---|---|
| 3 | —NH—$COCH_3$ | 157 |
| 4 | —NH—CO— | 148 |
| 5 | —NH— COOCH3 | 105 |
| 6 | —NH— —CO—$CH_3$ | 114 |
| 7 | —NH—CO—NH— $CH_3$ | 146 |
| 8 | —NH—CO—N( )$_2$ | 170 |
| 9 | —NH—CO—NH— —$NO_2$ | 196 |
| 10 | —NH—CO—CO—NH—CH—$CCl_3$ OH | 190 |
| 11 | —NH—CO—NH—CH—$CCl_3$ OH | 194 |
| 12 | —NH—$SO_2$— | |
| 13 | —NH—CO—N$(CH_3)_2$ | 74 |
| 14 | —NH—C—NH—CN NH | 168 |
| 15 | —NH—CO—CH—$C_2H_5$ CONH—CH—$CCl_3$ OH | 163 |
| 16 | —NH—$COCH_2CN$ | 155 |
| 17 | —$CH_2$—CO— | 76 |
| 18 | —$CH_2$—$COOC_2H_5$ | |

TABLE-continued

| Example | $Z_1$ | m.p. °C. |
|---|---|---|
| 19 | $-CH_2NO_2$ | 45 |
| 20 | 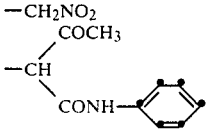 | 134 |
| 21 | 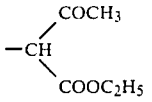 | |
| 22 | 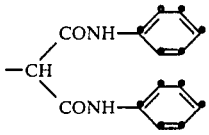 | 187 |
| 23 | 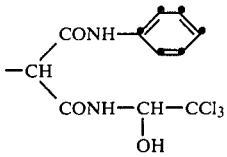 | 170 |
| 24 | $-CH_2-COCH_3$ | 74 |
| 25 | $-S-n-C_{12}H_{25}$ | |
| 26 | 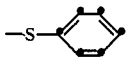 | 57-60 |
| 27 | 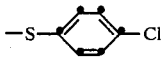 | 65 |
| 28 | 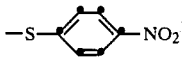 | 65 |
| 29 | 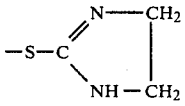 | 161-163 |
| 30 | 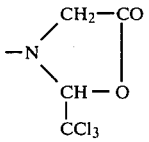 | 116 |
| 31 | 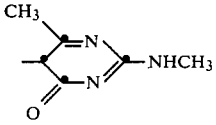 | 202 |
| 32 | 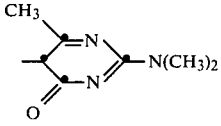 | 221-222 |
| 33 | $-NH-CO-NH-n-C_4H_9$ | 137 |
| 34 | 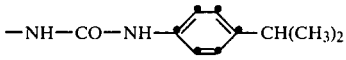 | 143 |

What I claim is:

1. A pressure-sensitive or heat-sensitive recording material which comprises sheet material coated with a color former and the same or different sheet material coated with a color developer containing at least one compound of the formula $$Z-\underset{\underset{OH}{|}}{CH}-A_1-(X_1)_m \qquad (1)$$

wherein Z is the radical of a reactive organic methylene or methyl compound or a radical of the formula $$-N\begin{matrix}D_1\\E\end{matrix} \quad (1a) \qquad . -\underset{\underset{D_1}{|}}{N}-W-\underset{\underset{D_2}{|}}{N}-\underset{\underset{OH}{|}}{CH}-A_2-(X_2)_m \quad (1b)$$

or $$-S-G \qquad (1c)$$

wherein each of $A_1$ and $A_2$ independently is carbon or unsubstituted or substituted alkylene, arylene or aralkylene, each of $X_1$ and $X_2$ is halogen, cyano or nitro, each of $D_1$, $D_2$ and E independently is unsubstituted or substituted alkyl, aralkyl, aryl, alkanoyl, alkylsulfonyl, aroyl, arylsulfonyl, cyanoamidino, or is the group $$-CON\begin{matrix}R_1\\R_2\end{matrix} \quad \text{or} \quad -SO_2N\begin{matrix}R_1\\R_2\end{matrix},$$

wherein each of $R^1$ and $R^2$ independently is hydrogen or unsubstituted or substituted alkyl, aryl or aralkyl, whilst $D_1$ and $D_2$ are also hydrogen, or each of the pairs of substituents ($R_1$ and $R_2$) and ($D_1$ and E) together with the nitrogen atom to which said pair is attached is a 5- or 6-membered heterocyclic radical, W is —CO—, $-SO_2-$, —COCO—, $$-CO-\overset{\overset{R_1}{|}}{CH}-CO-$$

or unsubstituted or substituted alkylene or phenylene, G is unsubstituted or substituted alkyl, aralkyl or aryl, or is a 5- or 6-membered heterocylic radical, and m is 1 to 6.

2. A recording material according to claim 1 which comprises a developer of the formula (1), wherein each of $X_1$ and $X_2$ is halogen.

3. A recording material according to claim 1 which comprises a developer of the formula (1), wherein each of the groupings $-A_1-(X_1)_m$ and $-A_2-(X_2)_m$ is $-C(Hal)_3$, wherein Hal is halogen.

4. A recording material according to claim 1 which comprises a developer of the formula (1), wherein Z is a radical of the formula (1a) or (1b).

5. A recording material according to claim 1 which comprises a developer of the formula (1), wherein Z is a radical of the formula (1a).

6. A recording material according to claim 1 which comprises a developer of the formula (1), wherein each of $D_1$, $D_2$ and $R_1$ is hydrogen.

7. A recording material according to claim 1 which comprises a developer of the formula (1), wherein Z is the radical of the formula $$-N\begin{matrix}D_3\\E_1\end{matrix} \qquad (2a)$$

or $$-\underset{\underset{D_3}{|}}{N}-W_1-\underset{\underset{D_4}{|}}{N}-\underset{\underset{OH}{|}}{CH}-A_3-(X_3)_m \qquad (2b)$$

wherein each of $D_3$, $D_4$ and $E_1$ independently is alkyl of 1 to 12 carbon atoms, benzyl, phenyl, alkanoyl of 1 to 12 carbon atoms, benzoyl, alkylsulfonyl of 1 to 12 carbon atoms, phenylsulfonyl, each of which is unsubstituted or substituted by halogen, lower alkyl, lower alkoxy, lower alkylcarbonyl or lower alkoxycarbonyl, or is the group

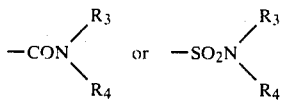

wherein each of $R_3$ and $R_4$ independently is hydrogen, alkyl of 1 to 12 carbon atoms, benzyl or phenyl, whilst $D_3$ and $D_4$ are also hydrogen, or the pairs of substituents ($R_3$ and $R_4$) and ($D_3$ and $E_1$) together with the nitrogen atom to which each pair is attached form a 5- to 6-membered heterocyclic ring which contains 1 or 2 heteroatoms selected from the group consisting of nitrogen, oxygen and sulfur, $W_1$ is —CO—, —$SO_2$—, —CO—CO—, —CO—$CH_2$—CO—, or alkylene of 2 to 6 carbon atoms or phenylene, each of which is unsubstituted or substituted by lower alkyl, lower alkoxy or halogen, and $A_3$ is carbon or alkylene of 1 to 6 carbon atoms or phenylene, $X_3$ is halogen, and m is 1 to 3.

8. A recording material according to claim 1 which comprises a developer of the formula

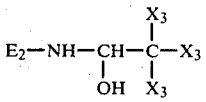

(3)

wherein $E_2$ is acetyl, benzoyl, acetophenyl, carbomethoxyphenyl, methylsulfonyl, phenylsulfonyl, N-methylcarbamyl, N-phenylcarbamyl, N-tolylcarbamyl or the group

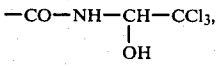

and $X_3$ is halogen.

9. A recording material according to claim 8 which comprises a developer of the formula (3), wherein $E_2$ is acetyl, benzoyl, acetophenyl, N-methylcarbamyl, N-phenylcarbamyl or N-tolylcarbamyl.

10. A recording material according to claim 9, wherein $E_2$ is N-phenylcarbamyl and $X_3$ is chlorine.

11. A recording material according to claim 1 which comprises a developer of the formula (1), wherein Z is a radical of the formula

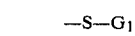

(2c)

wherein $G_1$ is $C_1$–$C_{18}$alkyl, benzyl or phenyl, each of which is unsubstituted or substituted by halogen, lower alkyl or lower alkoxy, or is a 5- or 6-membered heterocyclic radical which contains 1 or 2 ring nitrogen atoms.

12. A recording material according to claim 11 which comprises a developer of the formula

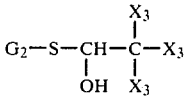

(4)

wherein $G_2$ is $C_1$–$C_{18}$alkyl, phenyl, halophenyl, $C_1$–$C_4$alkoxyphenyl or imidazolinyl-2-, and $X_3$ is halogen.

13. A recording material according to claim 1 which comprises a developer of the formula (1), wherein Z is a radical of the formula

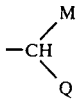

(1d)

wherein each of M and Q independently is cyano, nitro, unsubstituted or substituted alkylcarbonyl, alkoxycarbonyl or arylcarbonyl, or is the group

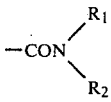

in which each of $R_1$ and $R_2$ is hydrogen or unsubstituted or substituted alkyl, aryl or aralkyl, whilst M is also hydrogen, or $R_1$ and $R_2$ together with the nitrogen atom to which they are attached, are a 5- or 6-membered heterocyclic radical, or M and Q together with the carbon atom which links them form a carbocyclic or heterocyclic ring which contains a keto group adjacent to the linking carbon atom.

14. A recording material according to claim 13 which comprises a developer of the formula (1), wherein Z is a radical of the formula

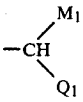

(2d)

wherein each of $M_1$ and $Q_1$ independently is cyano, nitro, or $C_2$–$C_{13}$alkanoyl, $C_2$–$C_{13}$alkoxycarbonyl, benzoyl or N-phenylcarbamyl, each of which is unsubstituted or substituted by one or more members selected from the group consisting of halogen, nitro, lower alkyl and lower alkoxy, and $M_1$ is also hydrogen, or $M_1$ and $Q_1$ together with the carbon atom which links them form a 5- or 6-membered carbocyclic or heterocyclic ring which contains a keto group adjacent to the linking carbon atom.

15. A recording material according to claim 14 which comprises a developer of the formula

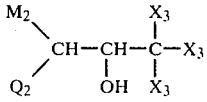

(5)

wherein $M_2$ is hydrogen, lower alkylcarbonyl or N-phenylcarbamyl, $Q_2$ is nitro, lower alkylcarbonyl, lower alkoxycarbonyl or benzoyl, and $X_3$ is halogen.

16. A pressure-sensitive recording material according to claim 1 which contains the colour former dissolved in an organic solvent.

17. A pressure-sensitive recording material according to claim 1, wherein the colour former is encapsulated in micro-capsules.

18. A pressure-sensitive recording material according to claim 17, wherein the encapsulated colour former is applied in the form of a layer to the back of a transfer sheet and the developer of the formula (1) is applied in the form of a layer to the face of a receiver sheet.

19. A pressure-sensitive recording material according to claim 1, which contains the compound of the formula (1) together with one or more other colour developers.

20. A heat-sensitive recording material according to claim 1 which contains, in at least one layer, at least one colour former, at least one developer of the formula as indicated in claim 1 and at least one binder.

* * * * *